US009484170B2

(12) United States Patent
Ikeda et al.

(10) Patent No.: US 9,484,170 B2
(45) Date of Patent: Nov. 1, 2016

(54) FUSE SECURING STRUCTURE FOR POWER SOURCE CIRCUIT CUTOFF DEVICE

(71) Applicant: YAZAKI CORPORATION, Tokyo (JP)

(72) Inventors: Tomohiro Ikeda, Makinohara (JP); Fumitoshi Henmi, Makinohara (JP); Yuichi Motoshige, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 312 days.

(21) Appl. No.: 13/951,989

(22) Filed: Jul. 26, 2013

(65) Prior Publication Data

US 2013/0307660 A1 Nov. 21, 2013

Related U.S. Application Data

(63) Continuation of application No. PCT/JP2012/051586, filed on Jan. 26, 2012.

(30) Foreign Application Priority Data

Jan. 28, 2011 (JP) ..... 2011-016765

(51) Int. Cl.
*H01H 37/04* (2006.01)
*H01H 85/00* (2006.01)
(Continued)

(52) U.S. Cl.
CPC ..... *H01H 37/04* (2013.01); *H01H 9/102* (2013.01); *H01H 85/0017* (2013.01); *H01H 85/203* (2013.01); *H01H 85/22* (2013.01); *H01H 85/54* (2013.01); *H01H 85/2035* (2013.01)

(58) Field of Classification Search
CPC .. H01H 9/102; H01H 37/04; H01H 85/0017; H01H 85/22; H01H 85/54; H01H 85/56–85/60; H01H 85/203; H01H 85/2035; H01H 85/545; H01H 85/547
USPC ..... 337/4
See application file for complete search history.

(56) References Cited

U.S. PATENT DOCUMENTS 4,270,836 A * 6/1981 Adam ..... 439/746
5,580,281 A * 12/1996 Takeuchi ..... H01H 85/2035 337/210

(Continued)

FOREIGN PATENT DOCUMENTS

CN 201041800 Y 3/2008
JP 56-82855 7/1981

(Continued)

OTHER PUBLICATIONS

Office Action issued by the Japanese Patent Office on Sep. 2, 2014 in counterpart Japanese Patent Application No. 2011-016765.

(Continued)

*Primary Examiner* — Anatoly Vortman
*Assistant Examiner* — Jacob Crum
(74) *Attorney, Agent, or Firm* — Sughrue Mion, PLLC

(57) ABSTRACT

Provided are: a plug body including a main body housing, a fuse having a pair of terminals protruding outside the main body housing with the fuse being accommodated in the main body housing, and a cover attached to the main body housing; a circuit accommodating body configured to accommodate a pair of terminals on a mating side connected to the pair of terminals of the fuse; a rotatable lever connected to the plug body and the circuit accommodating body and configured to connect and disconnect between the pair of terminals of the fuse and the pair of terminals on the mating side; and a fuse biasing portion configured to bias the fuse accommodated in the main body housing toward the cover.

2 Claims, 4 Drawing Sheets

(51) Int. Cl.

| | |
|---|---|
| ***H01H 85/22*** | (2006.01) |
| ***H01H 85/54*** | (2006.01) |
| ***H01H 9/10*** | (2006.01) |
| *H01H 85/20* | (2006.01) |

(56) References Cited

U.S. PATENT DOCUMENTS

| | | | | |
|---|---|---|---|---|
| 5,680,088 | A * | 10/1997 | Seki et al. | 337/194 |
| 5,816,858 | A * | 10/1998 | Kazarian | H01H 85/2045 439/366 |
| 5,831,508 | A * | 11/1998 | Ikeda | 337/35 |
| 2002/0115348 | A1* | 8/2002 | Fukumori | H01H 85/2035 439/620.34 |
| 2004/0222875 | A1* | 11/2004 | Izumi | 337/198 |
| 2006/0035495 | A1* | 2/2006 | Iwata | H01H 85/0417 439/160 |
| 2008/0242150 | A1 | 10/2008 | Chikamatsu et al. | |
| 2009/0033453 | A1 | 2/2009 | Deno et al. | |

FOREIGN PATENT DOCUMENTS

| | | |
|---|---|---|
| JP | 2007-250386 | 9/2007 |
| JP | 2009-37778 | 2/2009 |

OTHER PUBLICATIONS

Communication dated Dec. 12, 2014 from the State Intellectual Property Office of People's Republic of China in counterpart Application No. 201280003311.2.

Communication dated Jun. 2, 2016, issued by the European Patent Office in corresponding European Application No. 12739784.2.

* cited by examiner

FUSE SECURING STRUCTURE FOR POWER SOURCE CIRCUIT CUTOFF DEVICE

CROSS REFERENCE TO RELATED APPLICATION

This application is a Continuation of PCT Application No. PCT/JP2012/051586, filed on Jan. 26, 2012, and claims the priority of Japanese Patent Application No. 2011-016765, filed on Jan. 28, 2011, the content of both of which is incorporated herein by reference.

BACKGROUND

1. Technical Field

The present disclosure relates to a fuse securing structure for a power source circuit cutoff device which cuts off a power source circuit provided with a fuse.

2. Related Art

For example, in electric cars and hybrid vehicles, in order to maintain safety when doing maintenance of an electrical system dealing with a high power, a power source circuit is required to be cut off by a power source circuit cutoff device. Such a power source circuit cutoff device is provided with a fuse which cuts off a power source circuit when an excessive current flows.

Japanese Unexamined Patent Application Publication No. 2007-250386 discloses a related fuse securing structure 101 for a power source circuit cutoff device shown in FIGS. 1 and 2.

The fuse securing structure 101 for a power source circuit cutoff device is constituted of a plug body 103, a circuit accommodating body 105, a rotatable lever 107, and the like. The plug body 103 accommodates a fuse 109 and terminals 111, 111 of the fuse 109. The circuit accommodating body 105 stores terminals 113, 113 on the mating side. The rotatable lever 107 is rotated and operated to connect and disconnect the plug body 103 and the respective terminals 111 and 113 of the circuit accommodating body 105.

The plug body 103 is constituted of a fuse 109, a main body housing 115, and a cover 117. The fuse 109 is mounted to the main body housing 115 by pressing a cutout 119, provided in the terminal 111, with a jig 121 (see, FIG. 2). When the fuse 109 is mounted, a retention lance 123 of the main body housing 115 retains an upper surface of the terminal 111, and, at the same time, press-fit protrusions 125 provided in the terminal 111 are press-fitted in the main body housing 115 to support the fuse 109.

After that, when the cover 117 is mounted to the main body housing 115, a support portion 129 provided in the cover 117 is retained to the cutout 119 of the terminal 111, and a function of supporting the fuse 109 is reinforced.

SUMMARY

However, in an in-vehicle instrument constantly subjected to vibration, as with the fuse securing structure 101 for a power source circuit cutoff device, in press-fit retention of the press-fit protrusion 125 a terminal may be deformed due to press fitting, and by merely providing the retaining function of the retention lance 123 and the support portion 129, when the fuse 109 (terminal 111) is subjected to vibration to cause rattling of the fuse 109, the reliability of the connection portion between the terminals 111 and 113 may be lost.

An object of the present invention is to provide a fuse securing structure for a power source circuit cutoff device, which stably supports a fuse to eliminate rattling, and, thus, to enhance the reliability of a terminal connection portion.

A fuse securing structure for a power source circuit cutoff device in accordance with some embodiments, includes: a plug body including a main body housing, a fuse having a pair of terminals protruding outside the main body housing with the fuse being accommodated in the main body housing, and a cover attached to the main body housing; a circuit accommodating body configured to accommodate a pair of terminals on a mating side connected to the pair of terminals of the fuse; a rotatable lever configured to be operated to rotate while being connected to the plug body and the circuit accommodating body through a cam mechanism, approach or space the plug body and the circuit accommodating body by a cam thrust force of the cam mechanism, and connect and disconnect between the pair of terminals of the fuse and the pair of terminals on the mating side; and a fuse biasing portion configured to bias the fuse accommodated in the main body housing toward the cover is provided.

According to the above configuration, since the fuse biasing portion which biases a fuse accommodated in a main body housing to a cover or the main body housing and presses the fuse is provided, the fuse is stably supported. Accordingly, rattling of the fuse is prevented in an in-vehicle instrument constantly subjected to vibration, and the reliability of a terminal connection portion can be significantly enhanced.

The fuse biasing portion may be an elastically deformable arm portion provided in the main body hosing, and the arm portion may be configured to bias at least one of the pair of terminals of the fuse accommodated in the main body housing toward the cover to hold the terminal between the arm portion and the cover.

According to the above configuration, the elastically deformable arm portion (fuse biasing portion) is provided in the main body housing, and since a terminal of the fuse accommodated in the main body housing is biased toward the cover side by the arm portion, an effect equivalent to the above constitution is obtained.

At least one of the pair of terminals of the fuse may have a cutout configured to retain a jig upon mounting of the fuse, and the main body housing may have a retaining portion configured to be retained to the cutout upon the fuse being mounted to the main body housing to prevent disconnection of the fuse.

According to the above configuration, an effect equivalent to the above constitution is obtained.

Since a retaining protrusion retained to the cutout for a jig provided in the terminal is provided in the main body housing, the fuse is supported, and a function of preventing disconnection of the fuse can be further enhanced.

The fuse securing structure for a power source circuit cutoff device may further include an excessive displacement preventing rib provided at a position facing flexure of the fuse biasing portion and configured to control excessive flexure of the fuse biasing portion.

According to the above configuration, an effect equivalent to the above constitution is obtained.

Since the excessive flexure of the fuse biasing portion is controlled by the excessive displacement preventing rib, an excessive load is prevented from being applied to the fuse biasing portion when the fuse is mounted, for example, and the biasing function of the fuse biasing portion can be secured.

DETAILED DESCRIPTION

Figure 3:
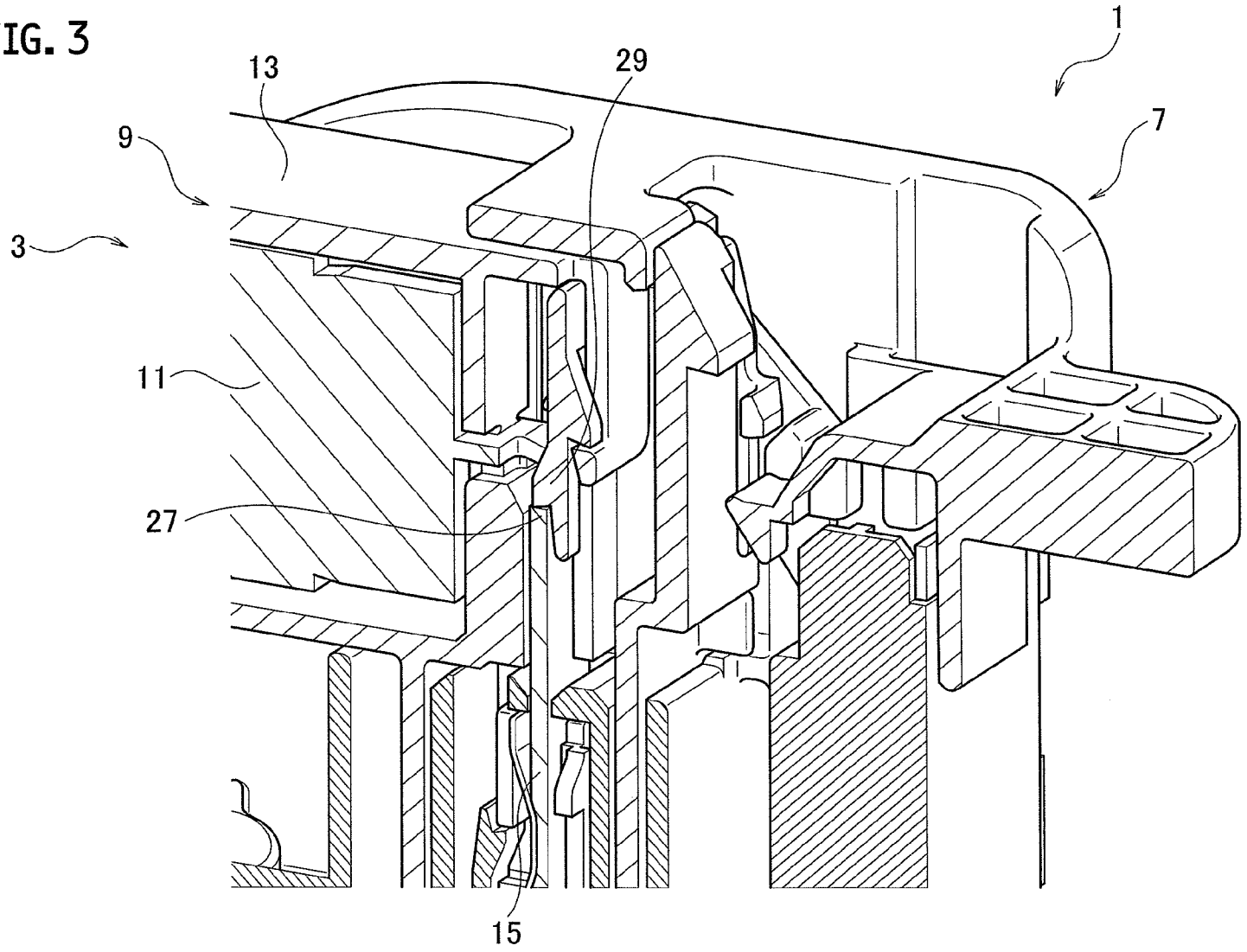
FIG. 3 is a cross-sectional view of a fuse securing structure for a power source circuit cutoff device according to an embodiment of the present invention whose one portion is cut away.
Figure 4:
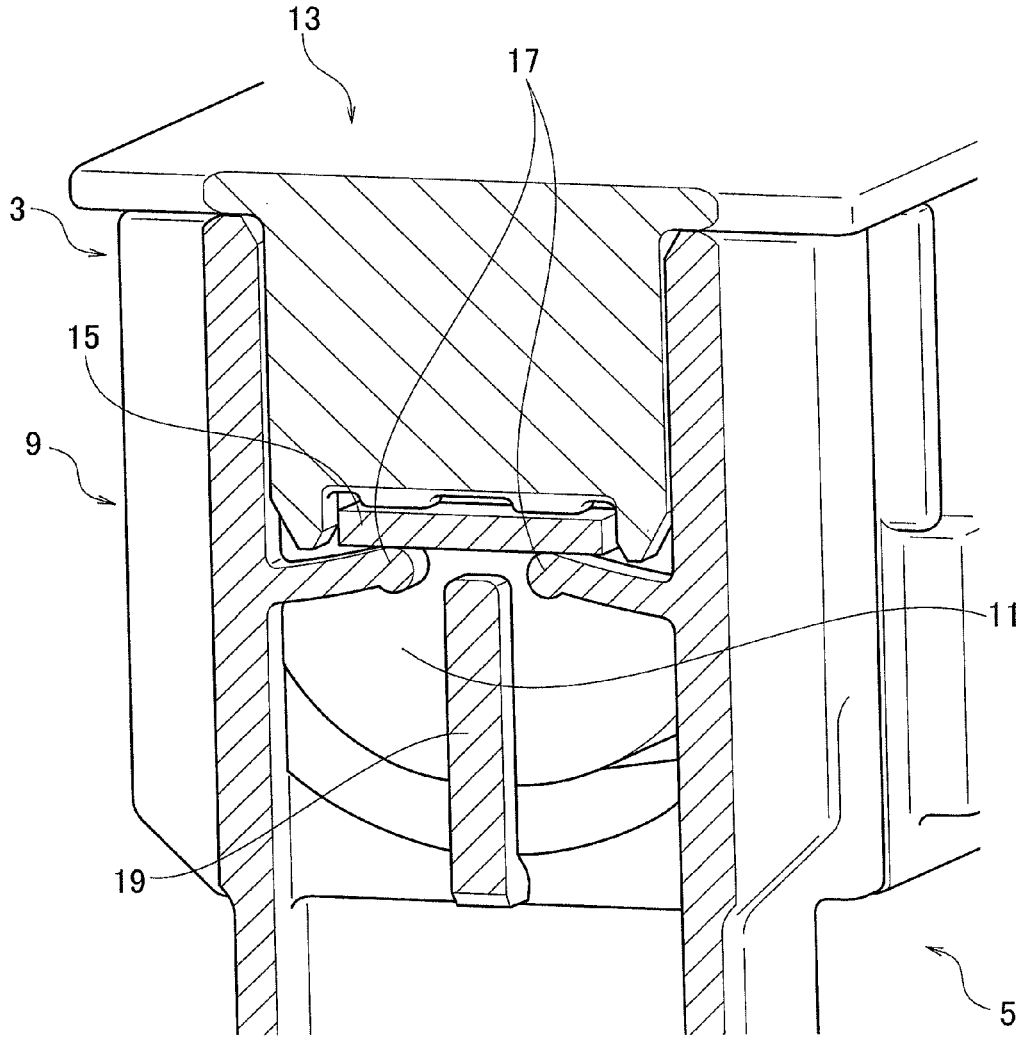
FIG. 4 is a cross-sectional view of the fuse securing structure for a power source circuit cutoff device according to the embodiment of the present invention whose other portion is cut away.
Figure 5:
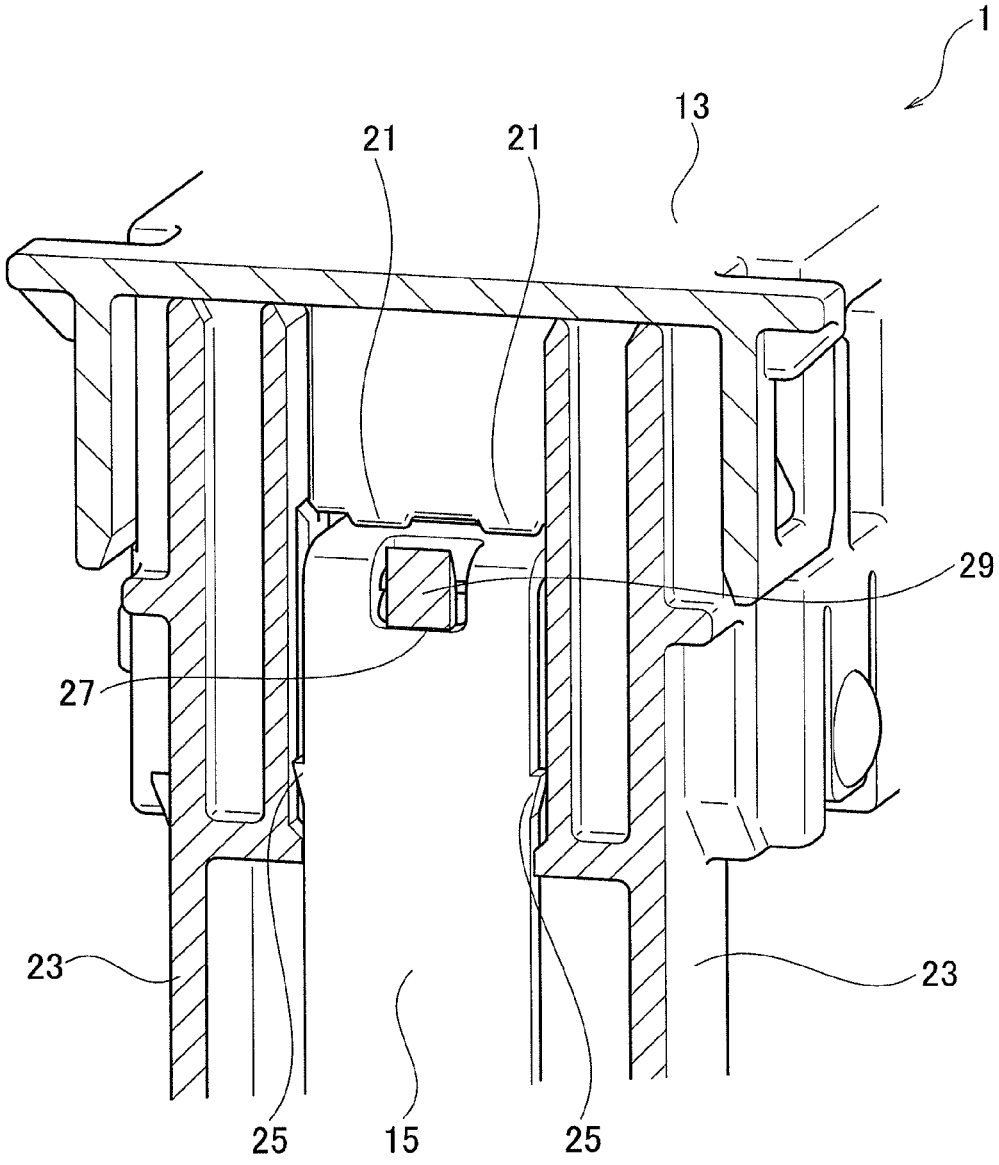
FIG. 5 is a cross-sectional view showing a cutout surface along a terminal of the fuse securing structure for a power source circuit cutoff device according to the embodiment of the present invention.

A fuse securing structure 1 for a power source circuit cutoff device according to an embodiment of the present invention will be based on FIGS. 3 to 5.

Structure of Fuse Securing Structure 1 for Power Source Circuit Cutoff Device The fuse securing structure 1 for a power source circuit cutoff device is constituted of a plug body 3, a circuit accommodating body 5, a rotatable lever 7, and the like. The plug body 3 is constituted of a main body housing 9, a cylindrical fuse 11, a cover 13, and the like. The fuse 11 is provided with a pair of terminals 15, 15 on its both end sides. Each of the terminals 15, 15 protrudes outside the main body housing 9 in such a state that the fuse 11 is accommodated in the main body housing 9. The cover 13 is attached to the main body housing 9 after the fuse 11 is mounted to the main body housing 9. The circuit accommodating body 5 accommodates mating side terminals connected to the terminals 15, 15 of the fuse 11.

The rotatable lever 7 is connected to the plug body 3 and the circuit accommodating body 5 through a cam mechanism. When the rotatable lever 7 is rotated and operated, the plug body 3 and the circuit accommodating body 5 approach or space from each other by the cam thrust force of the cam mechanism, and the plug body 3 (the main body housing 9) and each terminal of the circuit accommodating body 5 are connected to each other to turn on a power source circuit, and, thus, to release the connection, whereby the power source circuit is turned off.

As shown in FIG. 4, the main body housing 9 is provided with a pair of elastically deformable arm portions 17 (fuse biasing portions) provided at positions facing both end surfaces of the fuse 11. Each of the arm portions 17 presses a lower surface portion of the terminal 15 toward the cover 13 in such a state that the fuse 11 is accommodated in the main body housing 9 and prevents rattling of the fuse 11.

In the main body housing 9, an excessive displacement preventing rib 19 controlling the excessive flexure of the arm portion 17 is provided at a position facing the flexing direction of the arm portion 17 (lower side of FIG. 4).

As shown in FIG. 5, the cover 13 is provided with abutment protrusions 21. When the fuse 11 is mounted to the main body housing 9 and the cover 13 is mounted, the abutment protrusions 21 are abutted against an upper surface portion of the terminal 15 to prevent disconnection of the fuse 11.

Clearance fitting portions 25 reducing the rattling of the mounted fuse 11 (the terminal 15) are formed between terminal insertion grooves 23 provided in the main body housing 9 and the terminal 15.

A bent portion of the terminal 15 has a cutout 27 used when the fuse 11 is mounted. The main body housing 9 is provided with a retaining portion 29 retained to the cutout 27.

Figure 1:
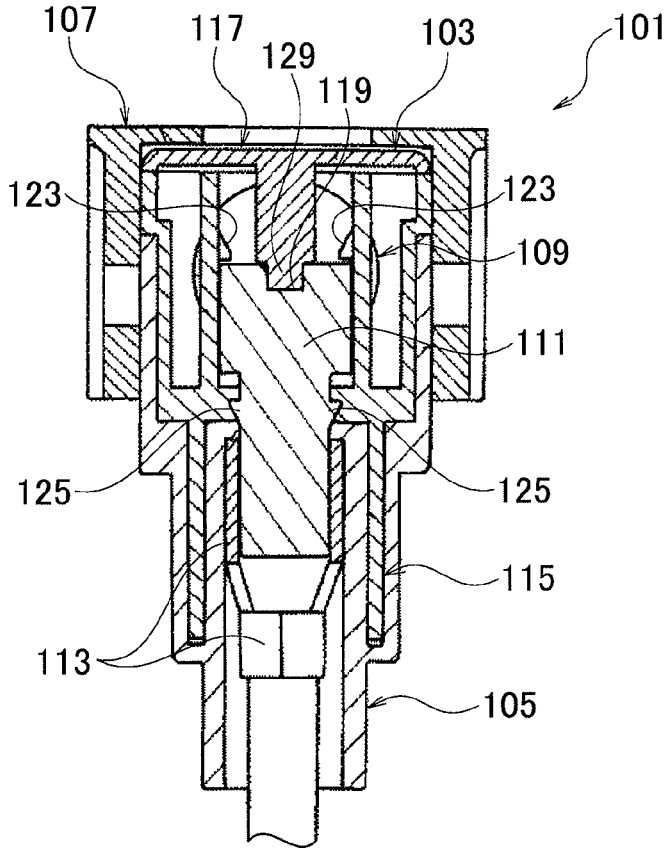
FIG. 1 RELATED ART
FIG. 1 is a cross-sectional view of a related fuse securing structure for a power source circuit cutoff device.
Figure 2:
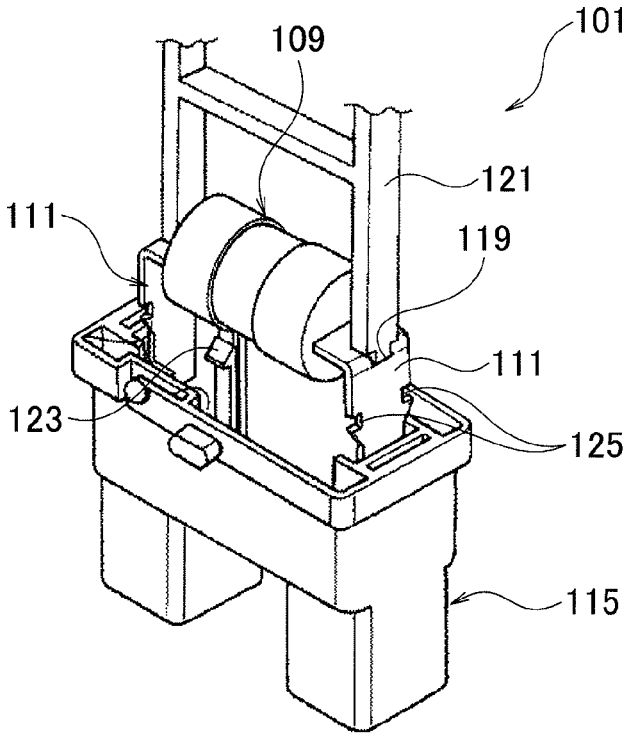
FIG. 2 RELATED ART
FIG. 2 is a perspective view of the related fuse securing structure for a power source circuit cutoff device.

When the fuse 11 is mounted to the main body housing 9, the jig 101 as shown in FIG. 2 is abutted against the cutout 27 and pressed, and the terminal 15 is inserted into the terminal insertion groove 23. At this time, the arm portions 17 are flexed to bias the terminal 15 upward, and, at the same time, the excessive displacement preventing rib 19 is abutted against the lower surface portion of the terminal 15 to control the flexure of the arm portion 17 to not more than a predetermined value. When the fuse 11 is thus mounted to the main body housing 9, the rattling of the terminal 15 is reduced by the clearance fitting portion 25 (the terminal insertion groove 23). When the jig 101 is removed after the mounting of the fuse 11, the retaining portion 29 is retained the cutout 27.

After that, when the cover 13 is attached to the main body housing 9, the biasing force of the arm portion 17 is applied to the cover 13 through the fuse 11, and the fuse 11 is stably held between the cover 13 and the main body housing 9 while vibration is absorbed by the biasing force of the arm portion 17.

In the above embodiment, although the arm portions 17, the excessive displacement preventing rib 19, the retaining portion 29, the cutout 27, the clearance fitting portions 25, and the abutment protrusions 21 are provided with respect to each of the terminals 15, 15 of the fuse 11, these components may be provided with respect to only one of the terminals 15, 15.

Effects of Fuse Securing Structure 1 for Power Source Circuit Cutoff Device

In the fuse securing structure 1 for a power source circuit cutoff device, as described above, the fuse 11 is stably held between the cover 13 and the main body housing 9 by the biasing force of the arm portions 17 (fuse biasing portions), and, at the same time, by virtue of the function of being retained to the cutout 27 (the terminal 15) according to the retaining portion 29 and the rattling reduction function of the clearance fitting portion 25, both the function of holding the fuse 11 and the rattling prevention function are enhanced.

When the fuse 11 is mounted, the excessive displacement of the arm portion 17 is controlled by the excessive displacement preventing rib 19 to prevent the bending and damage of the arm portion 17, and therefore, the function of supporting the fuse 11 according to the arm portion 17 can be maintained for a long period of time.

Accordingly, the rattling of the fuse 11 in an in-vehicle instrument constantly subjected to vibration is prevented, and the reliability of a terminal connection portion of a power source circuit cutoff device can be significantly enhanced.

The present invention can be used in not only electric cars but also a power source circuit cutoff device cutting off a power source circuit provided with a general fuse.

While the embodiments of the invention have been described, the invention is not limited to the above-described embodiments, and various modifications may be conducted.

What is claimed is:

1. A fuse securing structure for a power source circuit cutoff device, comprising:

a plug body comprising a main body housing, a fuse having a pair of terminals protruding outside the main body housing with the fuse being accommodated in the main body housing, and a cover attached to the main body housing;

a circuit accommodating body accommodating a pair of terminals on a mating side connected to the pair of terminals of the fuse;

a rotatable lever operating to rotate while being connected to the plug body and the circuit accommodating body through a cam mechanism, engaging or disengaging the plug body and the circuit accommodating body by a cam thrust force of the cam mechanism, and connecting and disconnecting between the pair of terminals of the fuse and the pair of terminals on the mating side; and a fuse biasing portion biasing the fuse accommodated in the main body housing toward the cover is provided, wherein the fuse biasing portion is an elastically deformable arm portion provided in the main body housing, wherein the arm portion abuts a lower surface of at least one of the pair of terminals of the fuse accommodated in the main body housing to bias the at least one of the pair of terminals toward the cover to hold the terminal between the arm portion and the cover with the cover abutting an upper surface of the at least one of the pair of terminals, wherein at least one of the pair of terminals of the fuse has a cutout retaining a jig upon mounting of the fuse, and wherein the main body housing has a retaining portion retaining the cutout upon the fuse being mounted to the main body housing to prevent disconnection of the fuse.

2. The fuse securing structure for a power source circuit cutoff device according to claim 1, further comprising an excessive displacement preventing rib provided at a position facing flexure of the fuse biasing portion and controlling excessive flexure of the fuse biasing portion.

* * * * *